United States Patent [19]

Carbone

[11] Patent Number: 5,015,499

[45] Date of Patent: May 14, 1991

[54] COMPOSITE GEM STONE AND PRODUCTION METHOD

[76] Inventor: Santo Carbone, Apt. 302, 916 - 16 Ave. N.W., Calgary, Alberta, Canada

[21] Appl. No.: 587,743

[22] Filed: Sep. 25, 1990

[51] Int. Cl.[5] ..... B05D 1/36

[52] U.S. Cl. ..... 427/203; 427/204; 427/294; 156/61; 428/15; 428/414

[58] Field of Search ..... 427/203, 204, 202, 294; 428/415, 414, 15, 323, 331; 156/61

[56] References Cited

U.S. PATENT DOCUMENTS

| | | | |
|---|---|---|---|
| 3,670,060 | 6/1972 | Cuffaro et al. | 264/77 |
| 4,657,791 | 4/1987 | Ukkonen | 428/15 |
| 4,664,954 | 5/1987 | Hurd | 428/15 |

FOREIGN PATENT DOCUMENTS

| | | | |
|---|---|---|---|
| 175484 | 3/1917 | Canada | 18/904 |
| 917372 | 12/1972 | Canada | 18/904 |
| 1248727 | 1/1989 | Canada | 18/904 |

*Primary Examiner*—Shrive Beck
*Assistant Examiner*—Benjamin L. Utech

[57] ABSTRACT

Composite or assembled gemstones are usually made by laminating together several layers of rock or mineral substances. Established lapidary processes used in making these stones are very effective when the gem-material part of the composite stone is of stable composition. Such material can then be easily cut and ground into the smooth flat layers necessary for laminating. These same methods, however, prove much less effective when applied to poorly-consolidated gem material: material that because of its friable nature tends to chip and flake when attempts are made to cut it into layers. My process is designed specifically for use on this latter type of gem material and is especially suited to processing gem-quality fossil ammonite shell. This process differs from the traditional methods in that it eliminates the need for cutting and grinding the gem material into smooth, flat layers. Instead, the gem material is simply shredded or fragmented into a mass of small, thin flakes. These flakes are then sprinkled on to pre-finished, crystal clear, adhesive covered bases and are overlain by another sprinkling of a dark granular substance. The composite stone is ready for use when the adhesive sets.

4 Claims, No Drawings

COMPOSITE GEM STONE AND PRODUCTION METHOD

This process relates to the manufacture of composite or assembled gemstones for use in jewelry and decorative products.

Traditional lapidary methods used for making composite or assembled gemstones generally involve some type of laminating process. Usually, several layers of rock or mineral substances are first prepared and then cemented together with suitable adhesives. These laminating techniques are used to impart strength and durability to soft and brittle gem-materials and to facilitate the handling of other materials that occur in very thin seams.

The familiar opal triplet is an example of a composite stone that is a lamination of three layers. Although there are many other kinds of composite stones, most, like the opal triplet, are constructed by joining together a number of prepared solid layers.

Some gem material, however, resists processing in the established manner because of its tendency to cleave and flake. And even when this type of material is successfully prepared for laminating, experience has shown that in some of the more poorly-consolidated varieties, cleaving and flaking sometimes occurs after the composite stone is completed.

A text-book example of the material just referred to is the iridescent shell of fossil ammonites found in southern Alberta, Canada. Although some of this relatively new gem-material is stable enough to be processed using conventional lapidary methods, a substantial amount of this fossil shell is found in layers of varying thicknesses consisting of numerous very thin lamellae that tend to easily cleave or separate from each other. Because of its almost mica-like tendency to cleave and flake, this very beautiful gem material remains virtually unused.

My process is designed specifically for use on the more unstable types of gem quality rocks and minerals and is especially suited to processing the more unstable variety of fossil ammonite shell just described. It is a simple process that utilizes and promotes a gem material's natural tendency to cleave and flake. This process differs from traditional methods in that it eliminates the necessity of cutting, grinding, and shaping the raw material to any prescribed form. It also eliminates the need for cutting and grinding the dark opaque layer that in some composite stones is used as a backing to the gem material both to strengthen it and to help highlight its colour by preventing light from passing right through it.

It should be noted that this process is best suited for those gem materials that like ammonite shell tend to crumble and shred very easily into paper thin, small flat flakes while at the same time retaining their ability to reflect colour.

1. The process begins with the shredding or fragmenting of a quantity of ammonite shell. This operation can be done manually with rock hammers or mechanically with rock grinders. It is continued until the gem material is reduced to a mass of thin flakes about 1 to 3 millimeters in size. Care must be taken to ensure that the shell is being shredded and not pulverized. Since ammonite shell occurs in a variety of colours, different coloured shell should be fragmented separately so that the colour of the finished gemstone can be regulated.

After fragmentation, the resulting flakes are screened to different particle size and stored. The size of the flakes that are used in making the gemstone can then be controlled.

2. A number of pre-finished quartz bases (caps) are placed polished surfaces down on a flat surface. Quartz caps are commercially available in a variety of sizes either in cabochon (oval) or free-form shapes. These caps are polished on one surface and sanded on the other. The polished surfaces of these caps can be either flat or domed. Other substances may be substituted in place of quartz provided that they are relatively hard, durable and crystal-clear.

A small amount of catalyzed epoxy-resin is applied to the surface of each quartz cap and spread evenly. The epoxy-resin must be slow-curing, water-clear, and of extremely low viscosity. Low-viscosity epoxy-resin must be used so that the light gem flakes can penetrate it easily.

3. Gem flakes of desired colour and size are sprinkled on to the epoxy-resin coated caps. This sprinkling action is continued until the quartz cap surfaces are completely covered.

4. The caps are transferred to a vacuum unit so that any air trapped during the sprinkling operation can be released.

5. The caps are then placed in a pre-heated oven where the epoxy-resin begins to harden. The temperature of the oven is set in accordance to the epoxy-resin manufacturer's instructions. The caps are removed from the oven at some point where the epoxy has reached a gel-like state. This point is variable and can best be ascertained by repeated testing of the epoxy-resin. At this point the gem-flakes imbedded in the epoxy become fixed and do not move around.

6. Silicon carbide in granular form (carborundum) is sprinkled on to the semi-cured epoxy-resin/gem flakes mixture. The sprinkling action is continued until the epoxy-resin cannot absorb any more carborundum. This silicon carbide coat prevents light from passing right through the stone and in so doing makes it possible for the gem flake to reflect their colour. It also provides protection for the gem flakes and gives the stone overall strength by acting as a filler for the epoxy-resin. Substitutes may be used in place of silicon carbide as long as the material that is used is dark is easily absorbed by the epoxy-resin.

7. The composite gemstones are put back in the oven and are ready for use when the epoxy-resin is fully cured.

The embodiment of the invention in which an exclusive property or privilege is claimed are defined as follows:

1. A process for making a composite gemstone utilizing gemstone material fragmented into minute thin flakes comprising the steps of:

(a) providing a prepared optically transparent support means having a front polished surface and a rear slightly roughed surfaces;

(b) applying to said rear surface a coating of clear, slow curing liquid epoxy resin;

(c) sprinkling said gemstone flakes onto said coating and allowing said flakes to settle to a point adjacent said rear surface with said coating;

(d) semi-curing said epoxy coating;

(e) applying to said semi-cured coating a layer of dark, translucent material and;

(f) heating said coating to harden same.

2. The process according to claim 1 including the step of evacuating between steps (c) and (d) to remove entrapped air.

3. The process according to claim 1 wherein said gemstone material is fossil ammonite shell.

4. The process according to claim 1, when the translucent material is granular silicon carbide.

* * * * *